US008590465B2

(12) United States Patent
Sandeman et al.

(10) Patent No.: US 8,590,465 B2
(45) **Date of Patent: *Nov. 26, 2013**

(54) LIQUID-COOLED GRILL PLATE COMPRISING WEAR PLATES AND STEPPED GRILL MADE OF SUCH GRILL PLATES

(75) Inventors: Michael Sandeman, Ras Al Khaimah (AE); Thomas Stiefel, Wetzikon (CH)

(73) Assignee: Doikos Investments Ltd., St. Helier, Jersey (GB)

( * ) Notice: Subject to any disclaimer, the term of this patent is extended or adjusted under 35 U.S.C. 154(b) by 910 days.

This patent is subject to a terminal disclaimer.

(21) Appl. No.: 12/673,537

(22) PCT Filed: Aug. 11, 2008

(86) PCT No.: PCT/CH2008/000343

§ 371 (c)(1),
(2), (4) Date: Mar. 11, 2010

(87) PCT Pub. No.: WO2009/023977

PCT Pub. Date: Feb. 26, 2009

(65) Prior Publication Data

US 2011/0232623 A1 Sep. 29, 2011

(51) Int. Cl.
*F23H 7/08* (2006.01)
*F23H 3/02* (2006.01)

(52) U.S. Cl.
CPC .. *F23H 3/02* (2013.01); *F23H 7/08* (2013.01); *F23H 2900/03021* (2013.01); *F23H 2900/17002* (2013.01)
USPC ..... 110/281; 110/255; 110/291; 110/300; 126/163 R; 126/175; 122/374

(58) Field of Classification Search
CPC ..... F23H 1/02; F23H 3/02; F23H 7/08; F23H 11/06; F23H 11/08; F23H 2900/03021
USPC ..... 110/268, 298, 299, 328, 255, 281, 282, 110/283, 284, 291, 300; 126/152 R, 163 R, 126/174, 175; 122/374, 375, 376
See application file for complete search history.

(56) References Cited

U.S. PATENT DOCUMENTS 1,852,492 A 4/1932 Tawlks
3,005,446 A 10/1961 Kock (Continued)

FOREIGN PATENT DOCUMENTS

WO WO95/21353 A 8/1995
WO WO99/63270 A 12/1999

*Primary Examiner* — Kenneth Rinehart
*Assistant Examiner* — David J Laux
(74) *Attorney, Agent, or Firm* — CUSPA Technology Law Associates; Yi Li

(57) ABSTRACT

The liquid-cooled grill plate has a carrier and drive design (15), having a separate cooling body (K) that can be placed into said carrier and drive design (15) and permeated by the liquid and having wear plates mounted onto said cooling body (K). The cooling body (K) is a welded design formed by square tube sections (20-26) and profiled sections (27), said design forming continuous elongated recesses (28-30) extending across the entire extension with the exception of the square tube sections (23-26) bridging said recesses (28-30). The carrier design is a ribbed configuration made of planar steel parts that are welded together and the drive unit (15) encloses a hydraulic cylinder-piston unit, which is accommodated in the inside of a square tube (18), said tube being guided displaceably in a tunnel-like breakthrough on said ribbed configuration. Between the wear plates and the cooling body (K) a highly heat-conductive soft silicone film (31) is clamped, which ensures good heat transfer. In this way, it is ensured that during operation the wear plates always remain in the non-critical temperature range in that they are cooled by the cooling body (K) disposed beneath, which heats up to about 50° C. Said grill plate is much easier and inexpensive to produce because the welding work is considerably reduced and less complex as a result of the use of a separate cooling body (K).

20 Claims, 13 Drawing Sheets

(56) References Cited

U.S. PATENT DOCUMENTS

Figure 1:
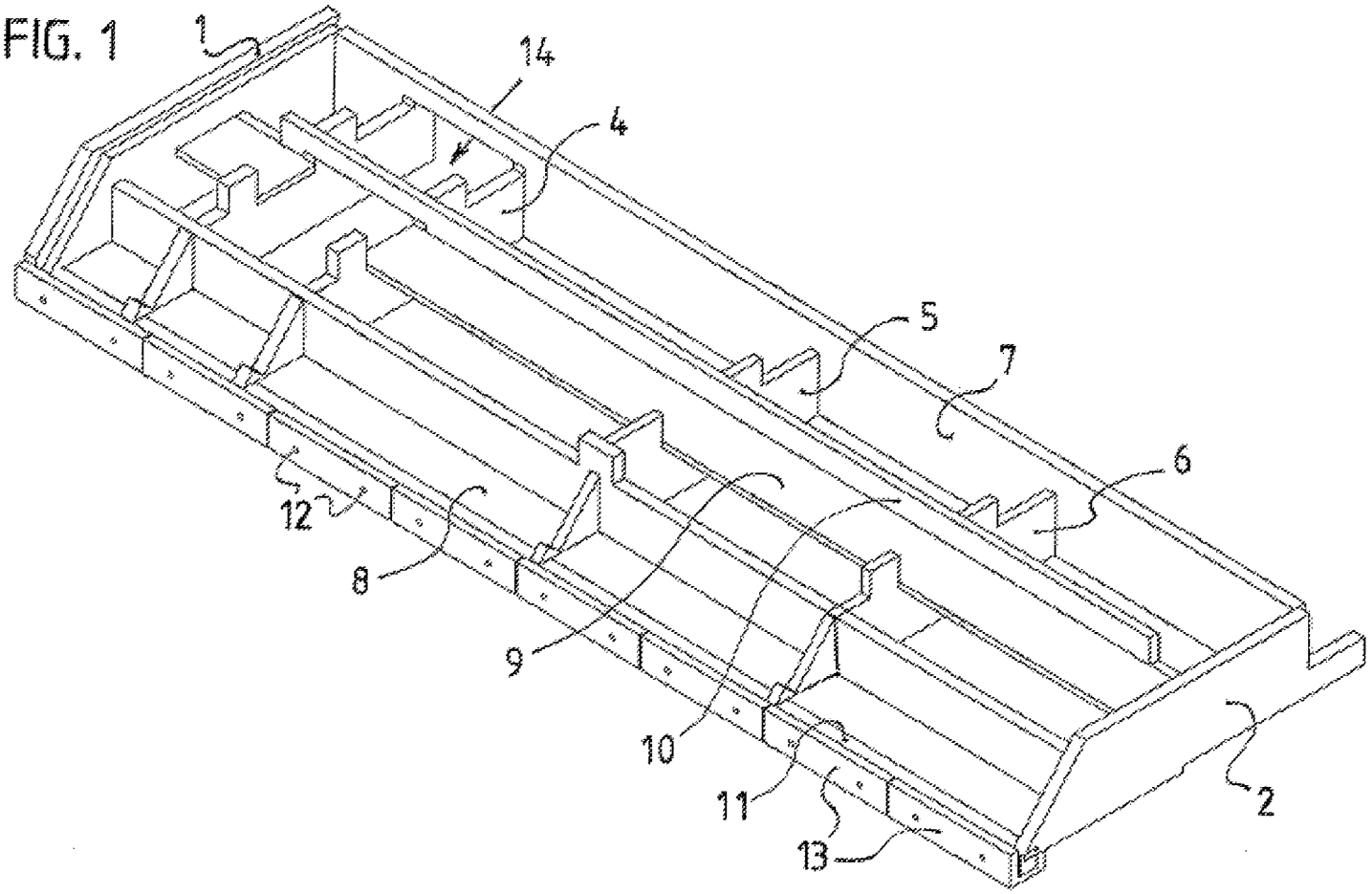

| | | | | |
|---|---|---|---|---|
| 3,263,655 | A | 8/1966 | Robson, Jr. | |
| 4,429,664 | A * | 2/1984 | Feldhoff et al. | 110/243 |
| 4,596,233 | A | 6/1986 | Hyde | |
| 5,538,128 | A * | 7/1996 | Stierll et al. | 110/281 |
| 5,575,642 | A * | 11/1996 | Willis et al. | 110/291 |
| 5,680,824 | A * | 10/1997 | Kemter et al. | 110/348 |
| 5,724,898 | A * | 3/1998 | von Bockh et al. | 110/291 |
| 6,024,031 | A * | 2/2000 | Stiefel | 110/281 |
| 6,220,190 | B1 | 4/2001 | Dumbaugh | |
| 6,269,756 | B1 * | 8/2001 | Sachs et al. | 110/298 |
| 8,256,361 | B2 * | 9/2012 | Stiefel et al. | 110/298 |

* cited by examiner

LIQUID-COOLED GRILL PLATE COMPRISING WEAR PLATES AND STEPPED GRILL MADE OF SUCH GRILL PLATES

In the past, water-cooled grate plates, such as those disclosed in EP 0 621 449, for example, were used for a liquid-cooled grate for garbage incineration, which are assembled to form a stepped grate by being disposed such that they overlap each other in a stairs-like manner. Each grade step can be displaced forward and backward in the direction of extension of the entire grate in order to produce a stoking and transport movement for the material to be incinerated located on the grate.

These liquid-cooled grate plates are composed of steel, which is approximately 10-12 mm thick, is canted and then welded together into two half shells such that a hollow space is created, through which the coolant, such as cooling water, a suitable oil, or a coolant mixed with specific components, can flow. For the surface, Hardox steel is used, for example, because it is considerably harder than conventional steel and therefore more wear-resistant. However, Hardox steel is also temperature sensitive and becomes soft above approximately 280° C. In order to prevent hardness weakening of the Hardox steel, welding is carried out in a water bath so as to continually dissipate heat from the welding site, as the temperature of Hardox steel must remain below approximately 280° C., because Hardox steel remains hard only up to this temperature. After welding, the grate plate must be straightened because due to the welding operation it has inevitably become stressed, as during welding high temperatures are generated in local regions and large temperature gradients are generated in the plate. It is known from the prior art to provide separate wear plates in those locations of the grate plate top sides where the grate plates stacked in a cascade shape come in contact with each other and as a result of the advancement movement of which wear is produced. If necessary, they can be exchanged, so that the base body of the grate plate can still be used. The wear plates can be placed directly onto the base bodies, for example, and can be welded thereto, or can also be fastened to the base body by means of screw connections.

In the solutions mentioned here, the wear plates are placed directly on the cooled grate plates. Although macroscopically these wear plates appear to rest flush on the cooled grate plates, it has been found that the heat transfer from the wear plate to the cooled grate plate is very limited. The liquid cooling of the cooled grate plate located beneath is therefore accordingly ineffective. Since microscopically the bottom sides of the wear plates, but also the top sides of the cooled grate plates are uneven, many small air gaps develop, and microscopically the plates have only punctiform contact, or truly rest on top of each other only in small raised regions and have close contact only there, as a result of which effective heat transfer takes place only in these locations, while everywhere else the air gaps have an insulating effect.

In these designs mentioned above, the grate plate through which liquid flows forms a grate step, the top side of which is provided with wear plates. The production of such a grate plate is very labor-intensive, because the process requires a large number of waterproof weld seams in order to assemble the grate plate from sheet metal parts in a waterproof manner. In order to be able to supply primary air to the fire through the liquid-cooled grate plate, the pipe sections are welded into the interior of the grate plate and penetrate the same from the bottom to the top. Each individual pipe section must be welded very carefully into the base and cover plates of the grate plate in order to ensure the assembly is leak-proof. This welding work is very sophisticated and complex. The grate plates produced in this way are therefore prone to faulty finishing, and repairs in the event leaks are detected are difficult. The reconditioning of such grate plates is also very complex and accordingly expensive. In addition, the large number of weld seams result in deformations during finishing, which make subsequent straightening of the grate plate necessary, and this straightening operation in turn entails the risk of the grate plate developing a leak somewhere.

It is therefore the object of the present invention to create a liquid-cooled grate plate and a grate composed of such grate plates, wherein the individual grate plate is to be produced from non-temperature sensitive, inexpensive iron or steel, but yet is to offer the required wear resistance, in that it is equipped with exchangeable wear plates. This grate plate, however, is to have a fault-tolerant design comprising considerably fewer weld seams subject to water exposure and is to enable considerably more simple and cost-effective production and possible repairs than conventional designs, while remaining dimensionally stable even on overheating. At the same time, this grate plate is supposed to allow significantly improved heat transfer from the wear plate to the liquid-cooled grate plate such that the cooling action is only marginally limited, despite the added wear plate.

This object is achieved by a liquid-cooled grate plate, comprising a carrier and a drive design, a separate cooling body which can be inserted in this carrier and drive design and through which liquid can flow, and by wear plates mounted thereon. The object is further achieved by a liquid-cooled stepped grate, comprising one or more grate plates per grate step, wherein these grate steps overlap and every second one is designed to be movable, and wherein in the event of a plurality of grate plates per grate step the carrier and drive designs of adjoining grate plates located next to each other are screwed together.

The invention is described in more detail based on the drawings and the function of the invention is explained.

Figure 2:
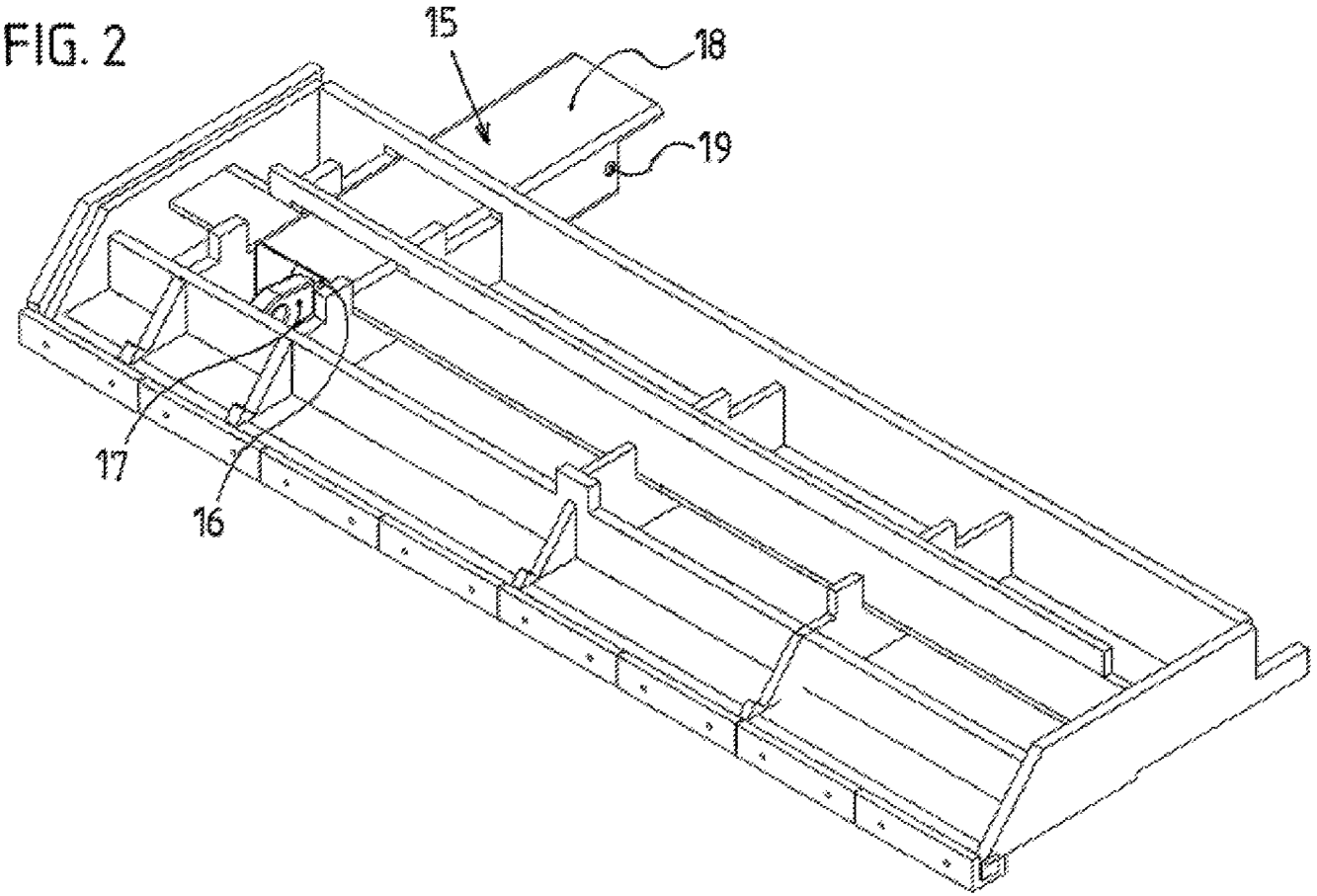
Figure 3:
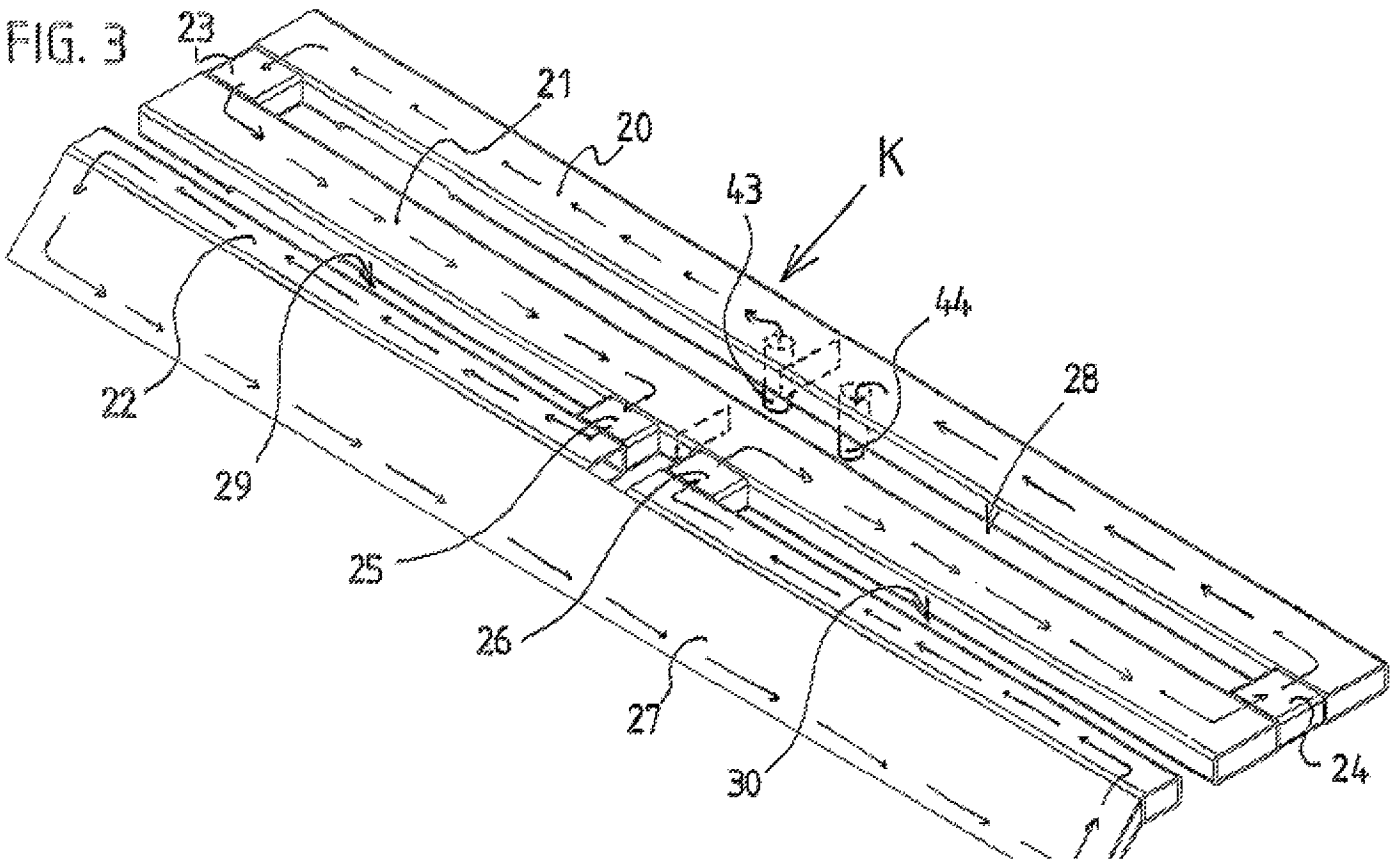
Figure 4:
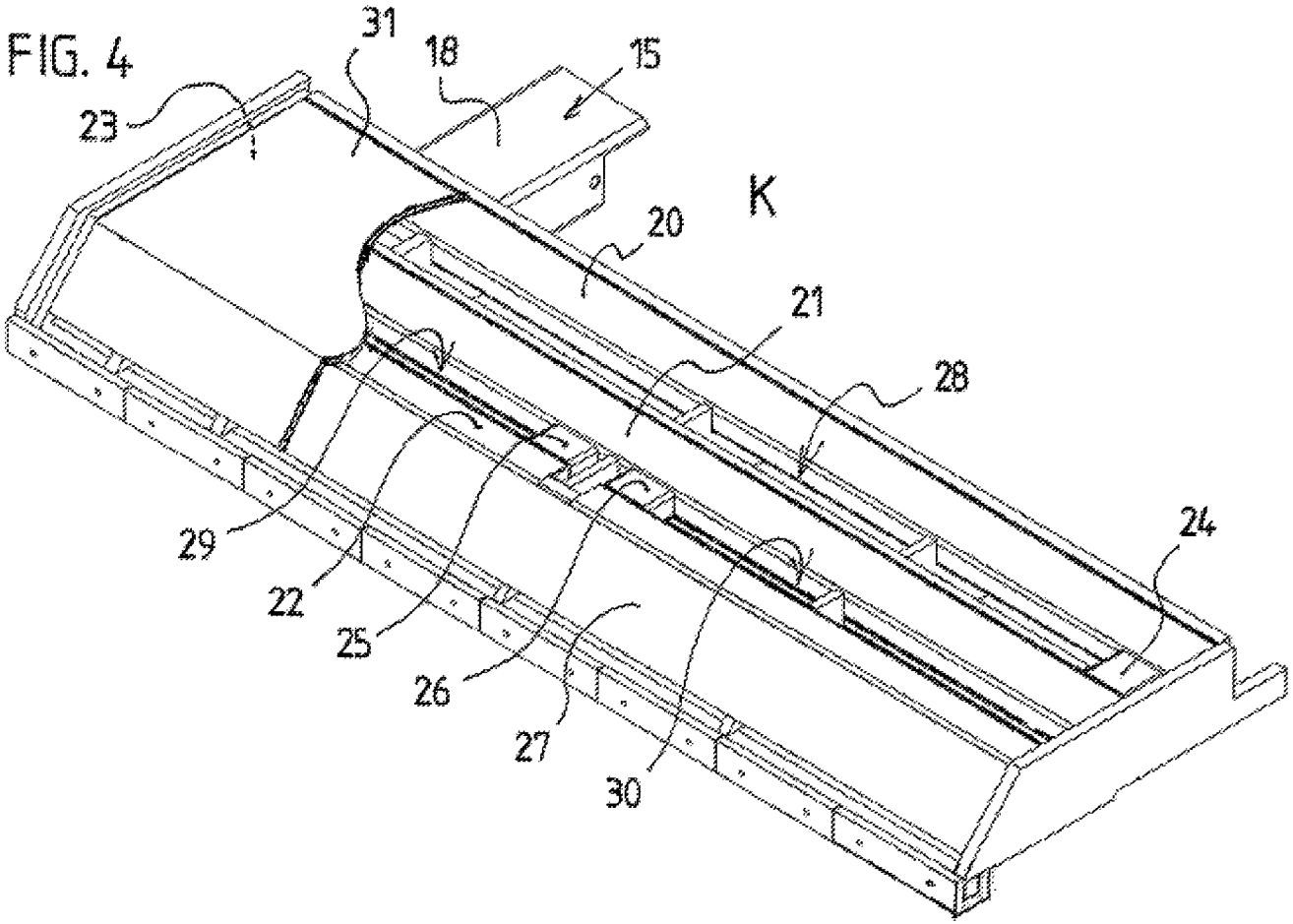
Figure 5:
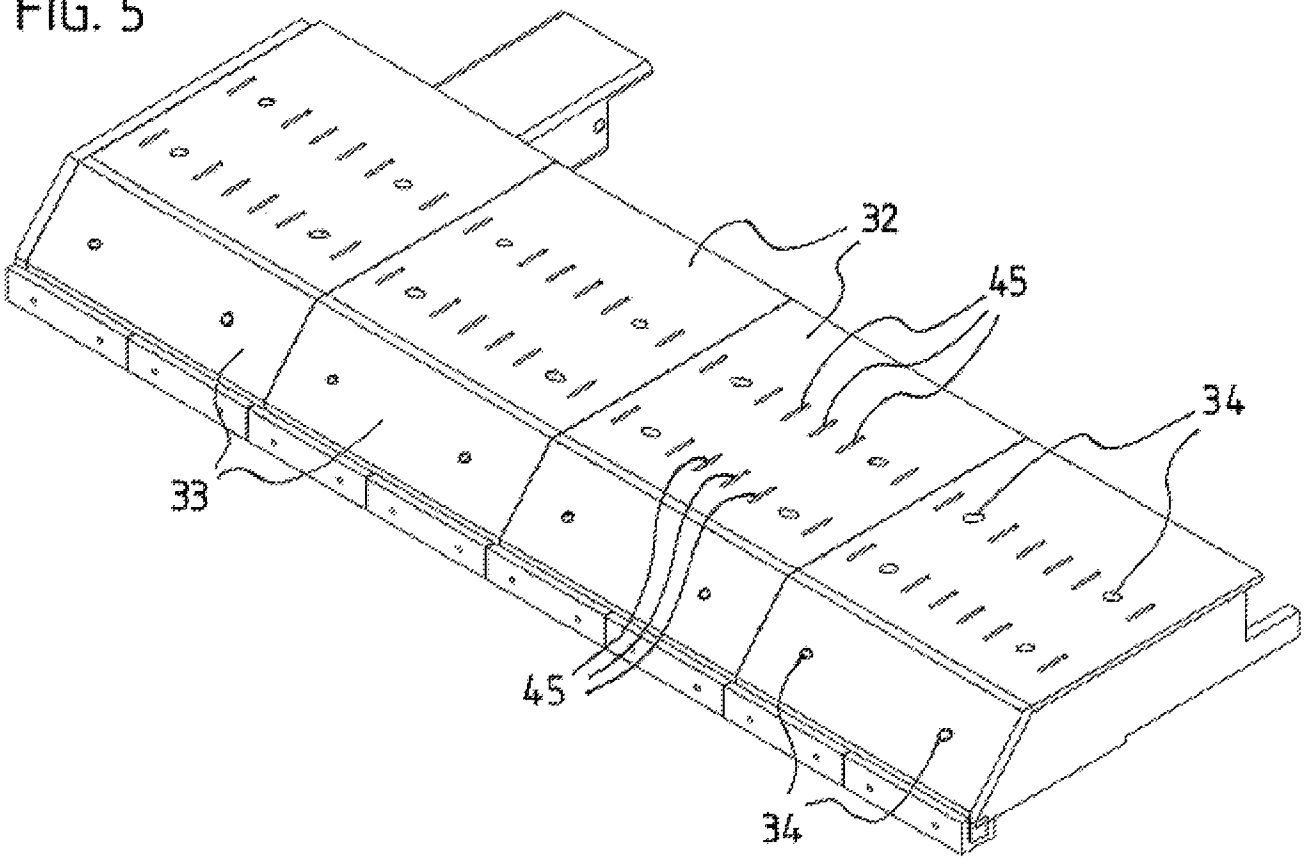
Figure 6:
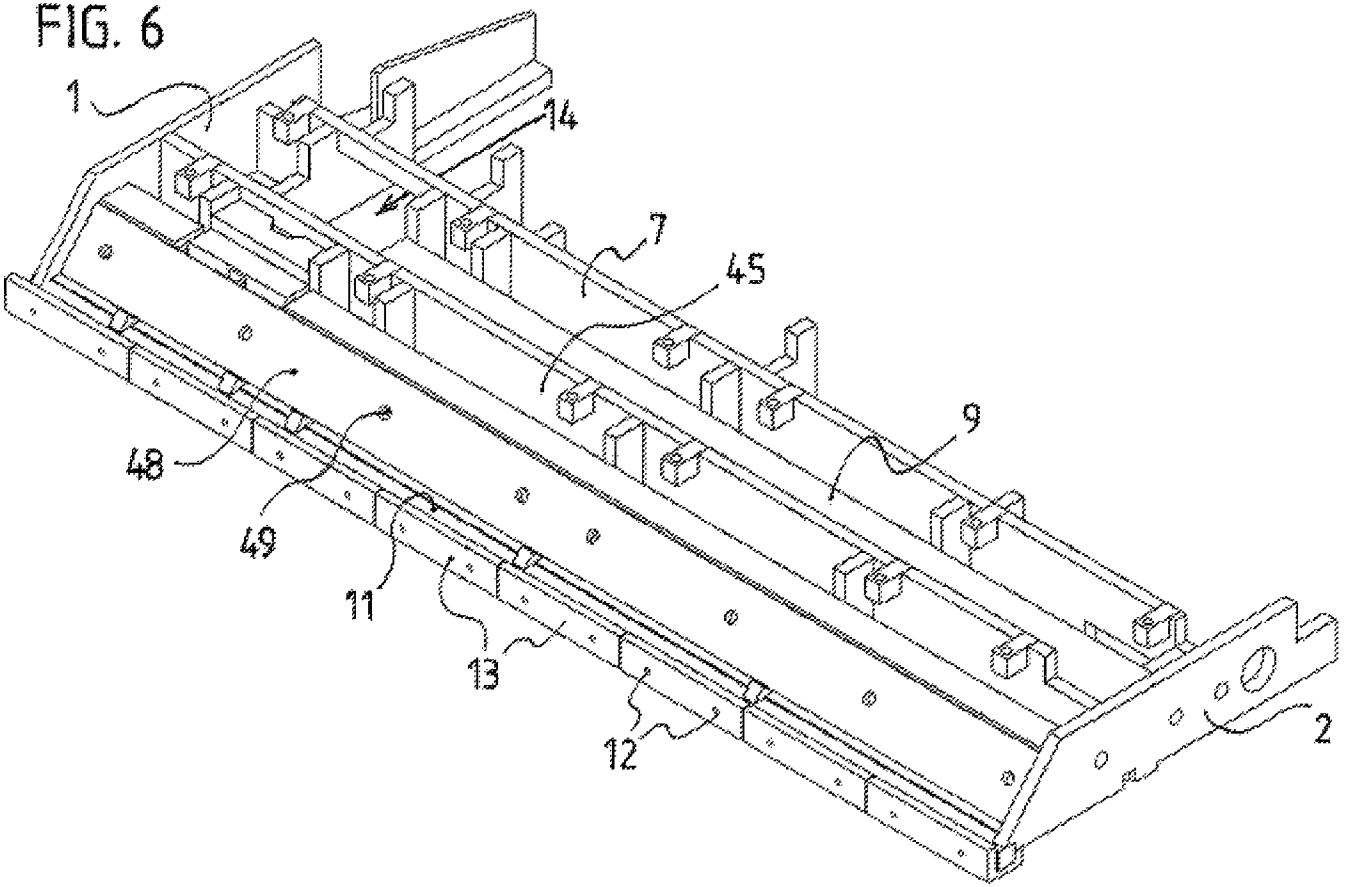
Figure 7:
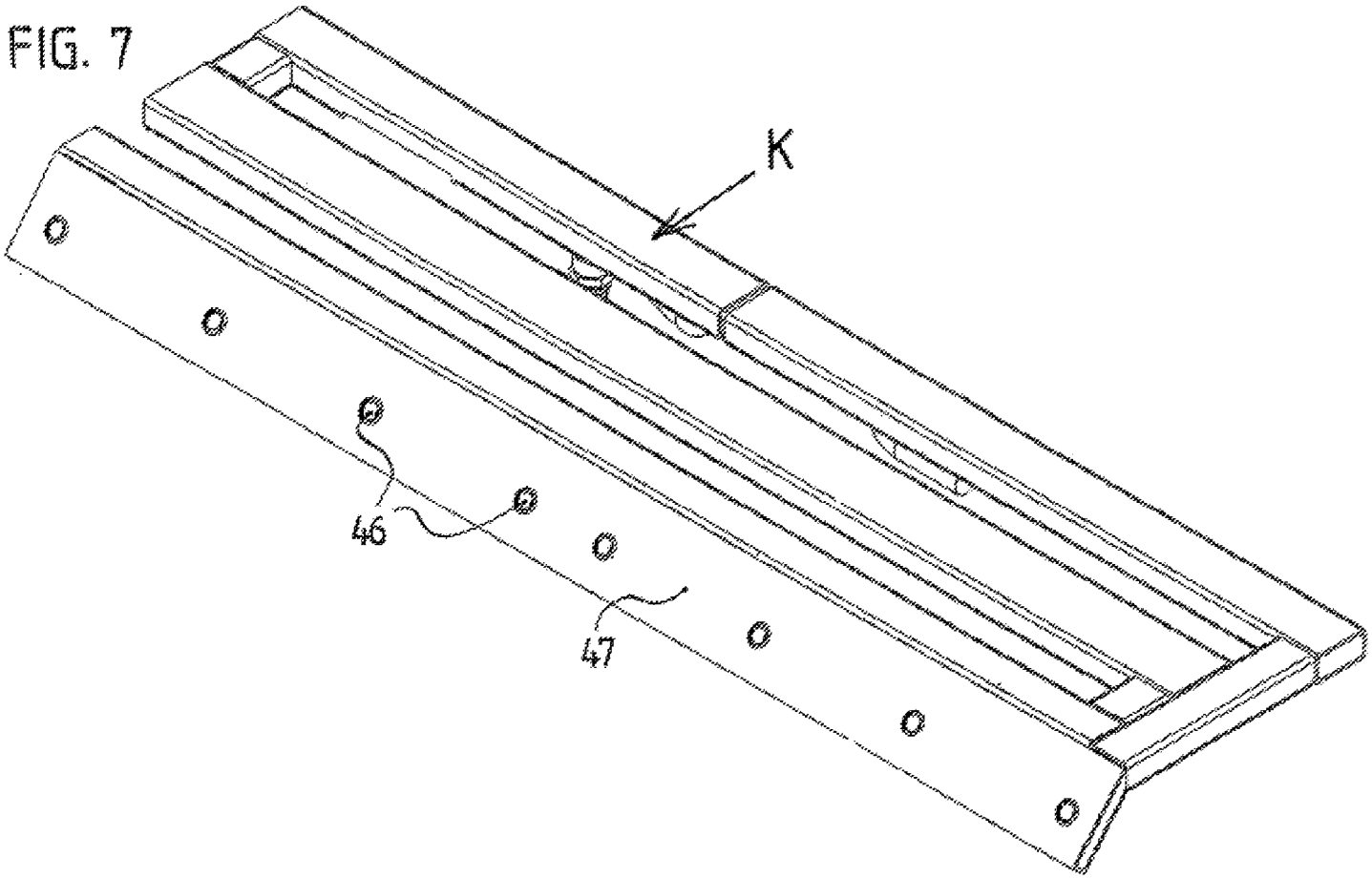
Figure 8:
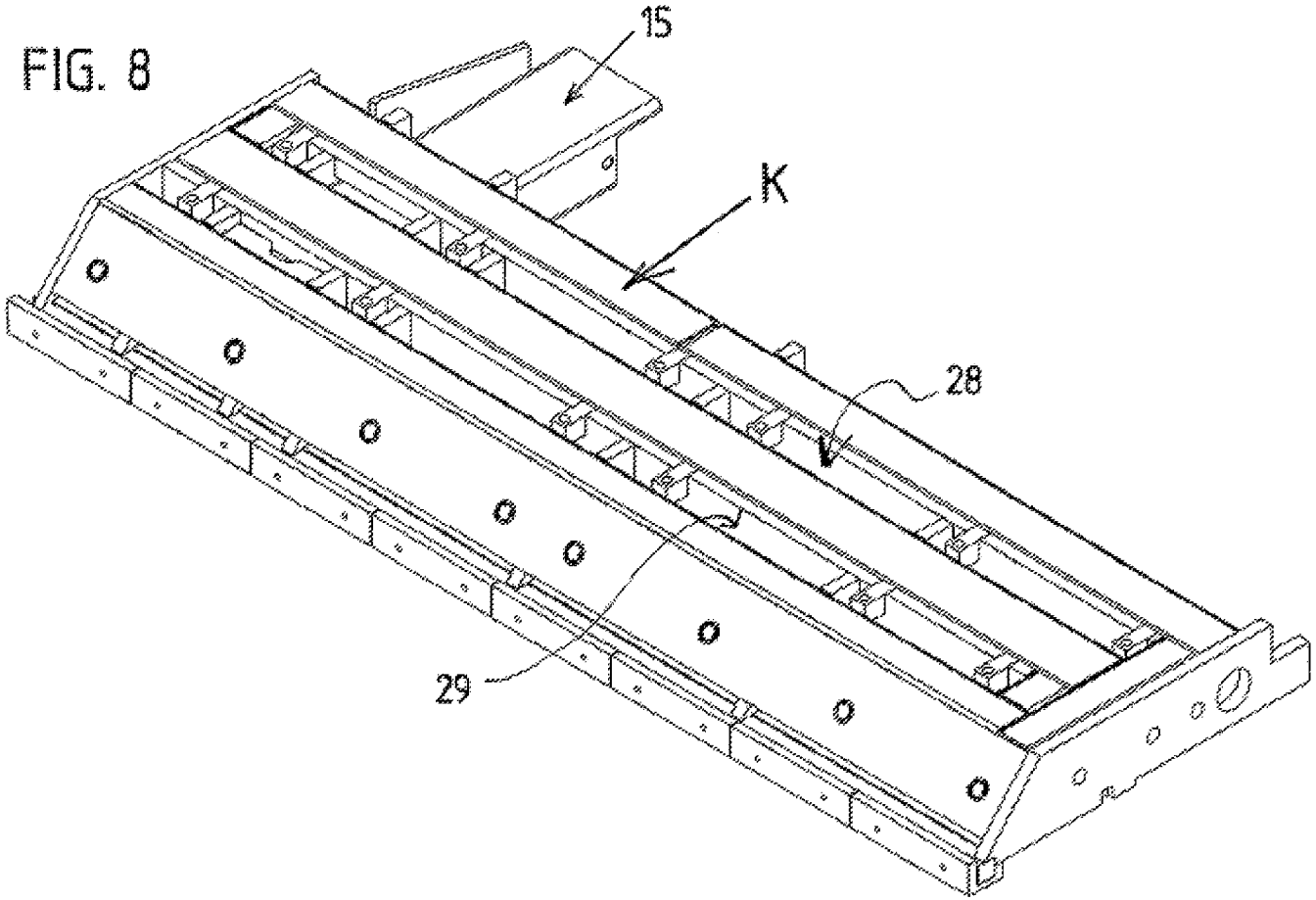
Figure 9:
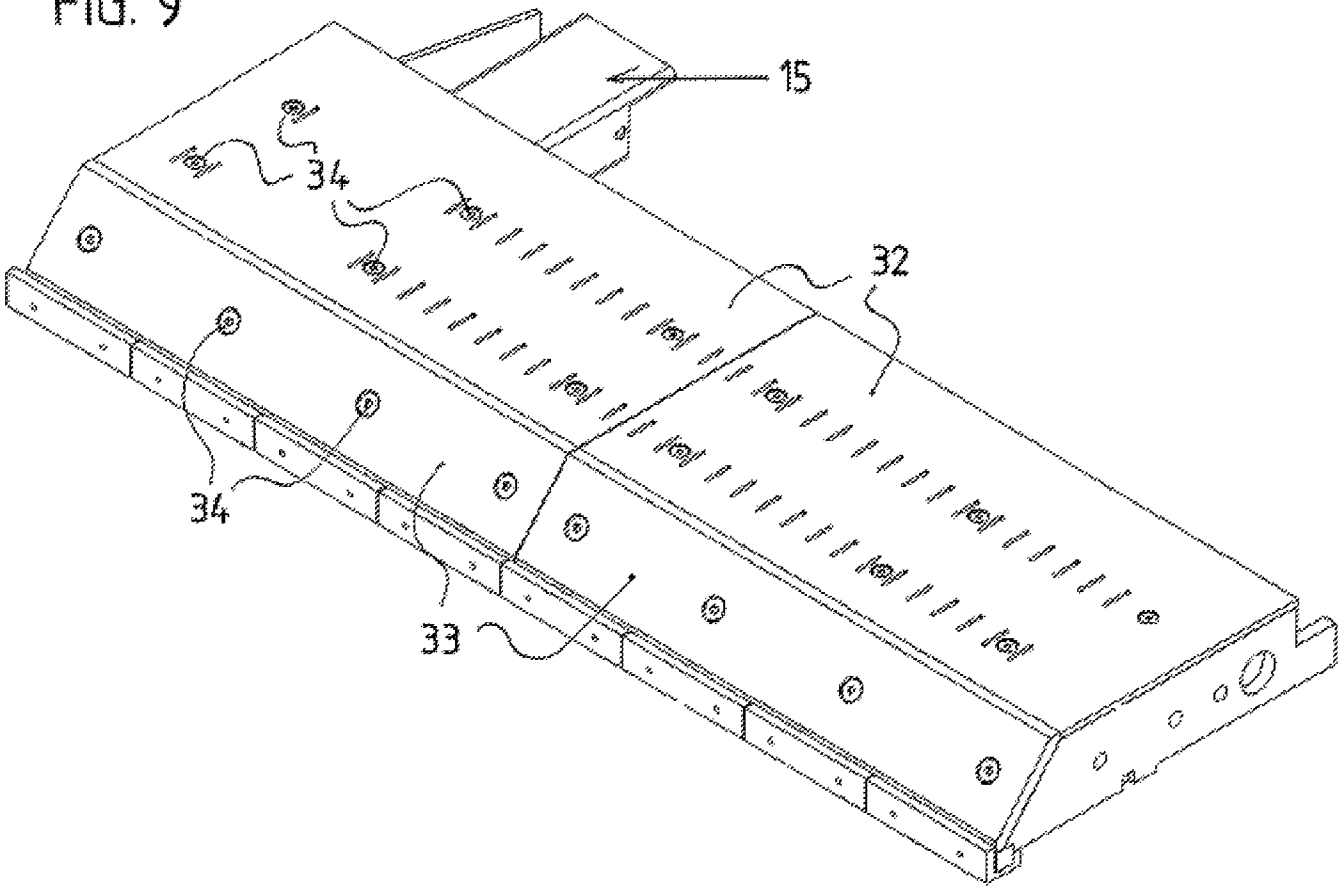
Figure 10:
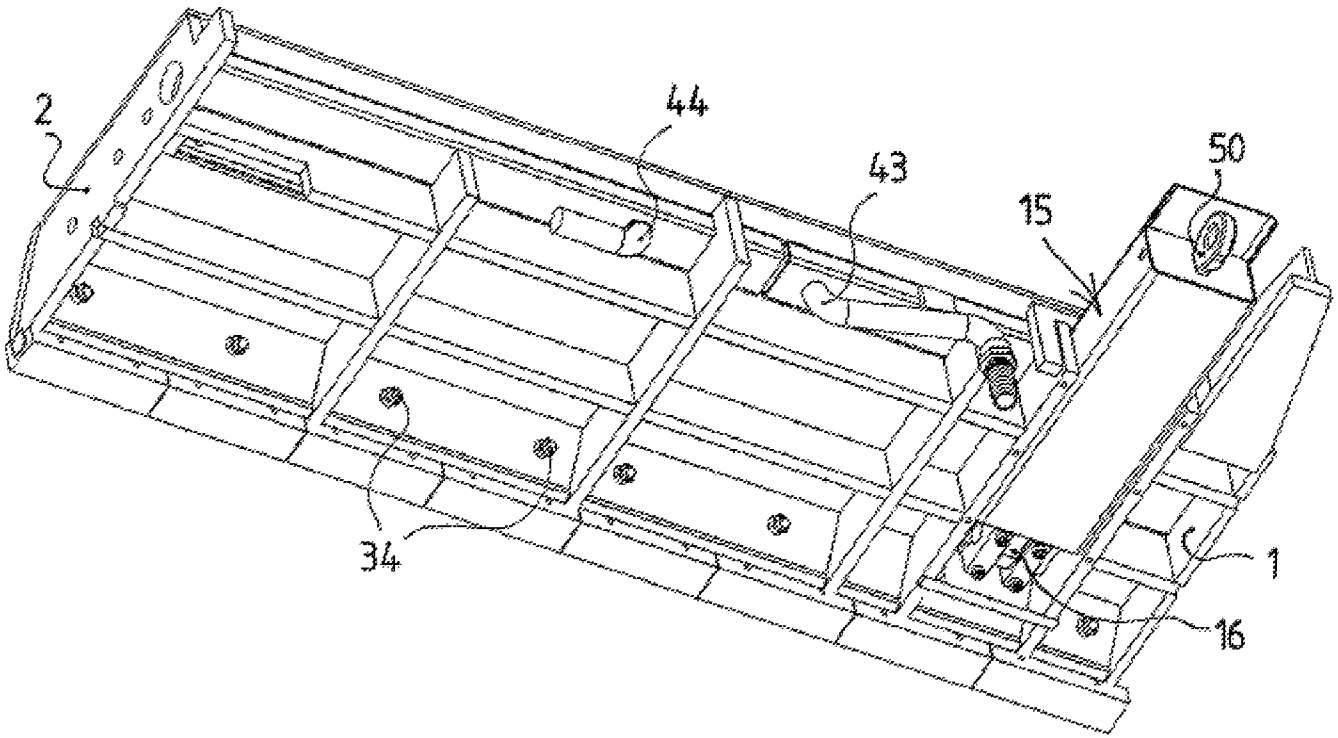
Figure 11:
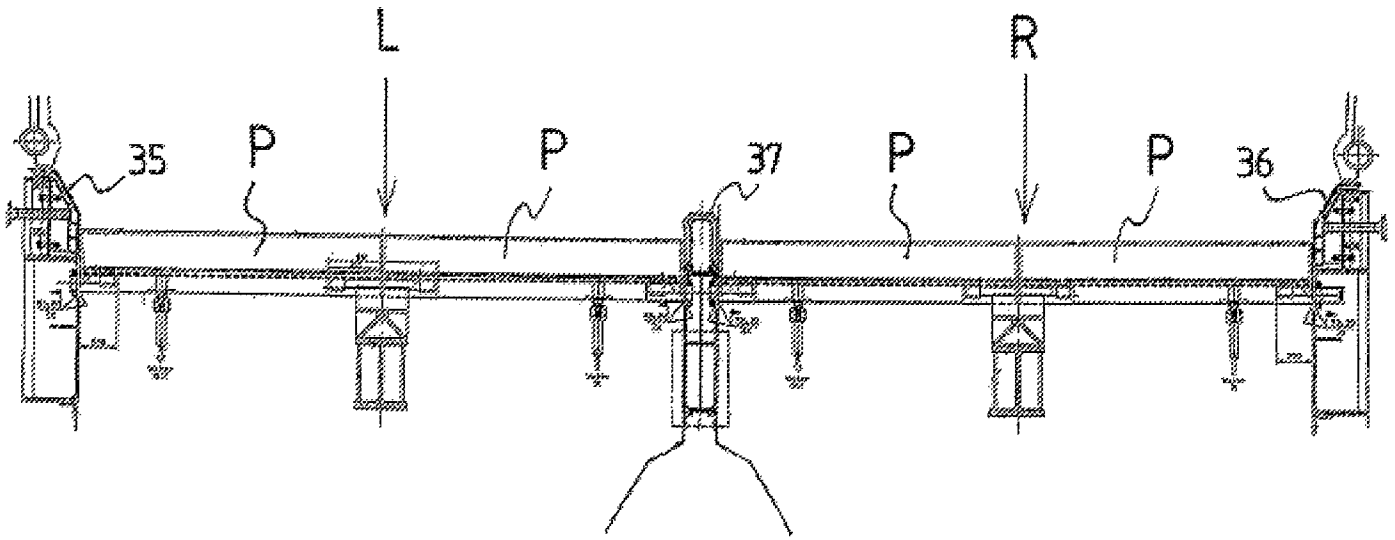
Figure 12:
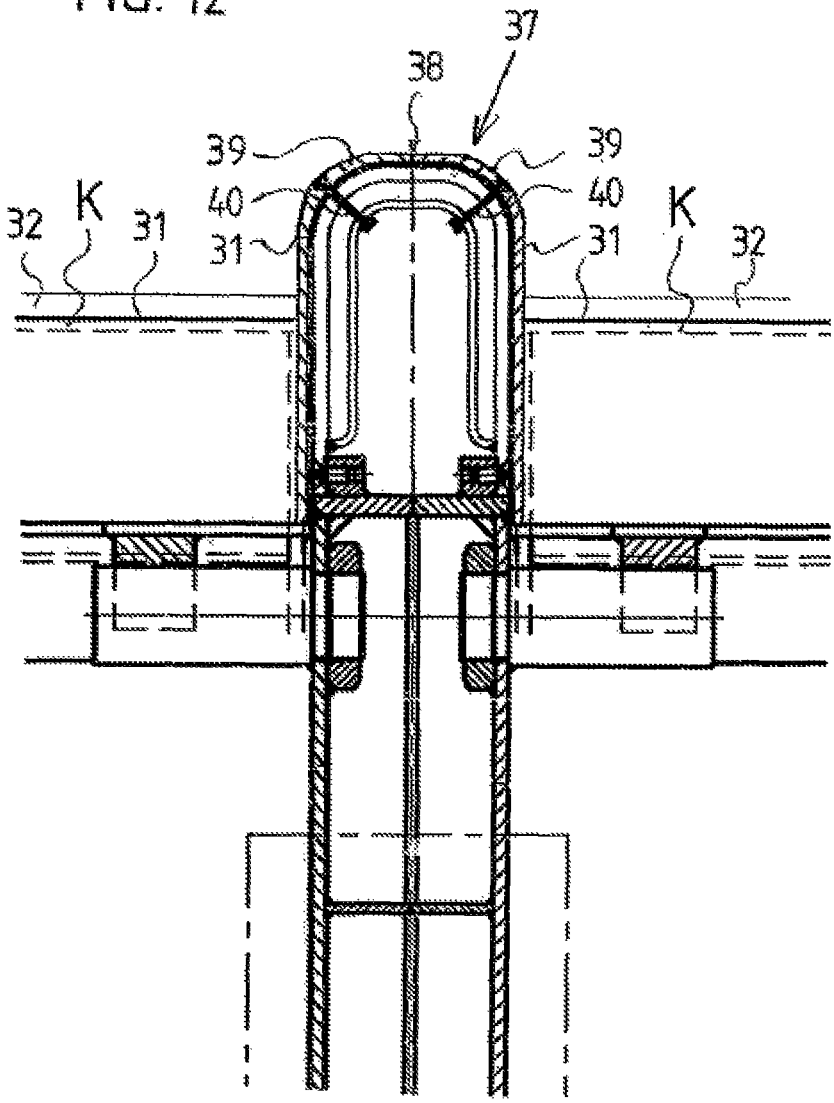
Figure 13:
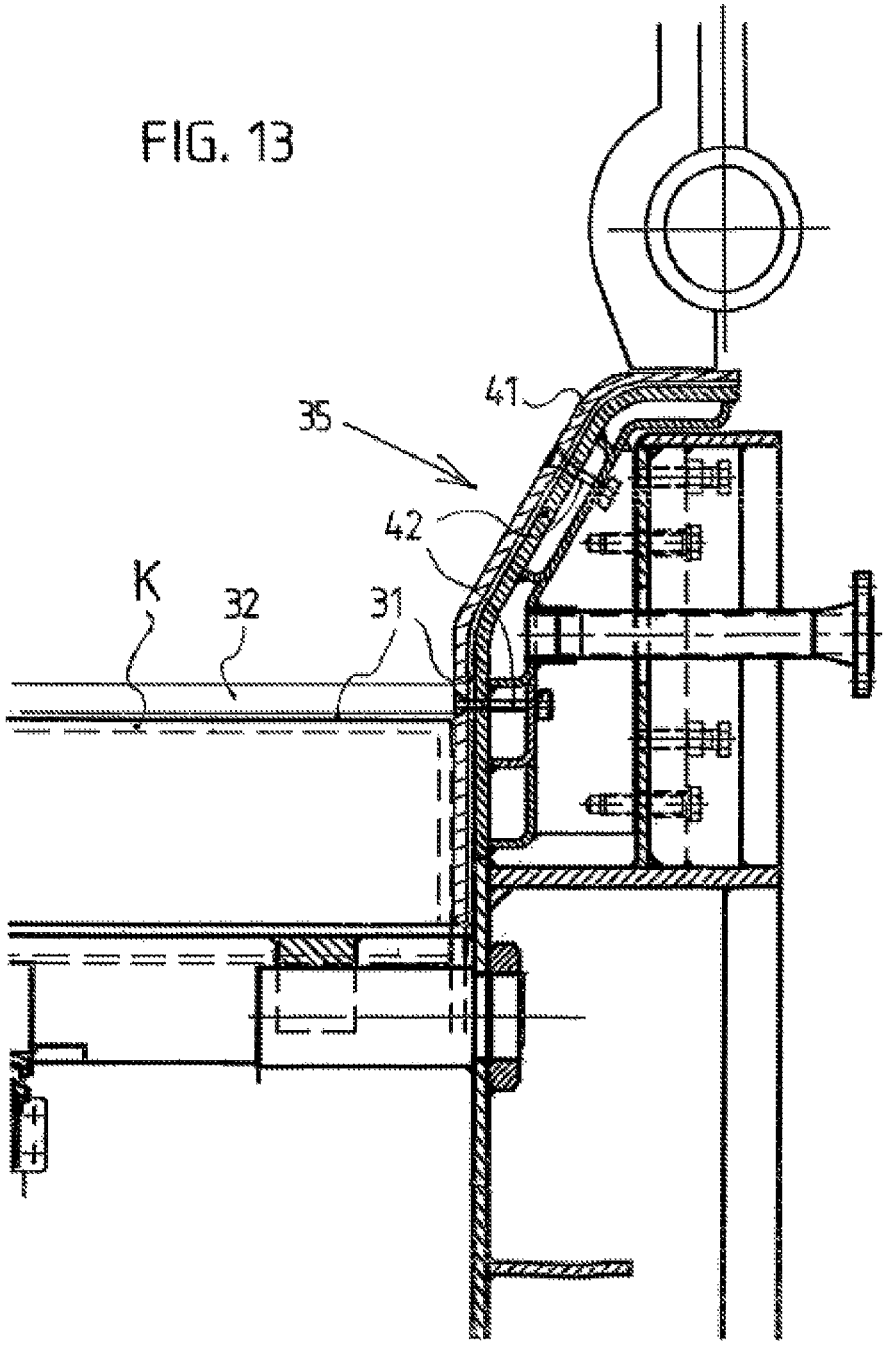

Shown are:

FIG. 1: The carrier design of an individual grate plate;

FIG. 2: The carrier design comprising a drive design of an individual grate plate;

FIG. 3: The liquid-cooled cooling body of the grate plate;

FIG. 4: The carrier and drive design having a cooling body inserted therein and thermally conductive foil placed thereon;

FIG. 5: The carrier and drive design having a cooling body inserted therein and wear plates mounted thereon by clamping the thermally conductive foil;

FIG. 6: An alternative carrier and drive design without transverse ribs on the inside;

FIG. 7: An alternative cooling body comprising apertures in the front for screwing on the front wear plates;

FIG. 8: The carrier and drive design according to FIG. 6 having a cooling body according to FIG. 7 inserted therein;

FIG. 9: The carrier and drive design having a cooling body inserted therein and wear plates mounted thereon by clamping the thermally conductive foil;

FIG. 10: The carrier and drive design in a bottom view, having a cooling body inserted therein and wear plates mounted thereon by clamping the thermally conductive foil;

FIG. 11: A sectional view transversely through a liquid-cooled stepped grate having two grate webs composed each of two adjoining grate plates that are screwed together and each have a separate interior cooling body;

FIG. 12: A sectional view transversely through the central plank of the liquid-cooled stepped grate having two grate webs;

FIG. 13: A sectional view transversely through the side plank of the liquid-cooled stepped grate having two grate webs.

As is shown in FIG. 1, the carrier design of an individual grate plate forms a carcass made of constructional steel. This carcass is produced from a number of steel sheets 1-10 that are welded to each other. In detail, the lateral walls 1, 2 disposed perpendicular to the plate plane and the rib pieces 3-6 arranged parallel thereto are welded together on the back sides thereof to a rear wall 7, on the front sides thereof to an angle profile 8, and at the center parts thereof to a horizontal center plate 9. The rib pieces 3-6 have a stepped upper edge such that space is created for inserting a cooling body, which then rests on these ribs 3-6 and on the center plate 9. A connecting strip 10, the upper edge of which ends flush with the upper edges of all vertical parts 1-6, is disposed on this center plate 9. A fastening strip 11 is welded onto the front edge of the angle profile 8, said fastening strip being equipped with bores 12 for fastening wear shoes 13 which, as is shown, have a U-shaped profile and by which the grate plate ultimately rests on the top side of the grate plate beneath after installation in a grate. On one side of the carcass, a tunnel-like aperture 14 entering from behind is visible, which is used for inserting a drive element.

FIG. 2 shows the carrier design with the drive unit 15 installed. This drive unit 15 comprises a hydraulic cylinder-piston unit 16, of which here the lug 17 at the end of the piston rod is visible. This lug 17 is rigidly connected to a pin at the carcass of the grate plate design. The hydraulic cylinder-piston unit 16 is accommodated protected on the inside of a rectangular tube 18 and rigidly connected thereto. At the rear end of the rectangular tube 18, a bore 19 is apparent, by means of which this rectangular tube 18 and interior cylinder-piston unit 16 are rigidly connected to a grate substructure. When extending the piston rod of the cylinder-piston unit 16, the carcass is thus pushed forward by the stationary rectangular tube 18. The rectangular tube 18 is therefore guided in the aperture 14 with little clearance. However, no special forces act between this rectangular tube 18 and the aperture 14, because the grate plate on the rear bottom side thereof is supported separately on rollers on the grate substructure.

FIG. 3 shows the liquid-cooled cooling body K of the grate plate, said cooling body being produced separately as a mounting module. The cooling body K is therefore a separate design and is composed of standard components, to the extent possible. For example, sections of long rectangular tubes 20-22 may be used, which are welded to each other from short welded-in rectangular tube sections 23-26 by cross connections to form a cooling body such that a meandering cooling flow is produced. The cooling pipe section 27 is tapered at the forward front of the grate plate and requires a dedicated weld design. This cooling body design, however, has only a fraction of weld seam lengths compared to a conventional water-cooled grate plate having an inner, welded-in labyrinth channel. Above all, the large number of apertures for conducting primary air through the cooling body can be foregone, because the cooling body in the present design comprises continuous recesses 28-30 which are disposed parallel to each other and overall extend practically over the entire length thereof. At the bottom of the rear side thereof, in the center region, the feed and return ports 43, 44 are installed. Starting from the feed port 43, coolant flows, as indicated by the arrows, through the interior of this cooling body and ultimately out of the same via the return port 44.

As is shown in FIG. 4, this cooling body K is simply inserted into the carcass of the carrier and drive design, in which it fits deliberately without requiring particular fastening therein in any manner. It rests on the ribs 3-6 and the center part thereof rests on the center plate 9, which is not visible here. The feed and return ports 43, 44 of the cooling body K protrude downward out of the carcass of the carrier design and cooling hoses can be connected thereto. A liquid flows through the cooling body K during operation. In most cases, it will merely be water, however oils or an oil mixed with specific components can also be used as the coolant. As was already shown in FIG. 3, the coolant meanders effectively across the entire surface of the grate plate and thereby dissipates heat from the surface thereof. The following provides a scale, which however can vary depending on the design and circumstances, and to which the design is not limited: For example, 7 $m^3$ coolant per hour is sent through such a grate plate, and the temperature thereof increases merely by approximately 2° C. between feed and return during operation. This minimal temperature increase clarifies that it is immaterial that first the fluid flows through one lateral half of the cooling body K, and only then through the other. It is important, however, that the cooling body comprises recesses 28-30, which are provided for allowing primary air to flow from beneath through the grate plate. In this way, welding in a plurality of through-pipe sections for conducting primary air through the interior of the cooling body can be foregone. Thereafter, a thermally conductive foil 31 is placed extensively across this cooling body, wherein this foil comprises cutouts which rest over the recesses 28-30. The drawing shows a section of this thermally conductive foil 31, although the thermally conductive foil of course covers the entire cooling body surface. The thermally conductive film is made, for example, of a soft metal, such as copper or aluminum, or an alloy composed of a plurality of soft metals. As an alternative to, or in addition to such a thermally conductive foil, a thermally conductive paste may be used. Such thermal pastes are used, for example, for thermally connecting and cooling semiconductors in the electronics industry, but they are also suited for the purpose here since they can be used up to 1300° C.

FIG. 5 shows the carrier and drive design having the cooling body inserted therein and the wear plates 32, 33 mounted thereon, which is to say screwed, riveted or attached thereon by wedges or gibs, by clamping this thermally conductive foil or a thermally conductive paste. In order to provide such a grate plate design with the necessary wear resistance, the surface must be considerably harder than conventional constructional steel, which can be used for the design of the carcass. The solution is to equip the top side of the grate plate, where this plate comes in contact with the material to be incinerated, with at least one separate wear plate 32 and to equip the front taper with a front wear plate 33, advantageously however with a plurality of such wear plates 32, 33, which are then easier to install and also to replace. Any material which is sufficiently hard and mechanically resistant and which, by way of cooling from the cooling body beneath, can be maintained at a temperature that does not jeopardize the hardness thereof is suited as a material for these wear plates 32, 33. In particular Hardox steel is suited as a construction material for the wear plates 32, 33, for example. These wear plates 32, 33—and this is very critical—are brought into the best possible thermal contact with the cooling body through which fluid can flow. The wear plates 32, 33 having a thickness of 5 to 10 mm, for example, are placed onto the cooling body K through which fluid can flow and are positively and non-positively screwed, riveted, attached or glued thereto. Corresponding holes are provided in the wear plates 32, 33 such that the screw heads 34 run flush with the wear plate surface. In order to ensure good heat conduction from the wear plates 32, 33 to the liquid-cooled cooling body K, a suitable thermally conductive material is inserted between the wear plates 32, 33 and the liquid-cooled cooling body K and clamped between them. This material is intended to compensate for all uneven regions and produce a close and snug mechanical connection and thermal bond of the wear plates 32, 33 with the cooling body. For example, what is referred to as a highly thermally conductive soft silicone foil, which covers the cooling body top side and also the forward tapered front side, as is shown in FIG. 4, has proven to be such an excellently thermally conductive material. Such soft silicone foils are soft, highly thermally conductive silicone foils by being filled with thermally conductive ceramics and exhibit extraordinary elasticity. They have proven to be particularly suited for dissipating heat resulting from different tolerances and uneven regions of two connecting pieces over a larger distance to a housing or a cooling body. In this, all the advantages of silicone as the base material come to bear, which is to say the high temperature resistance, chemical resistance and high dielectric strength, even though the latter property is not key for the present application.

Due to the high compressibility of the soft silicone foil, heat sources and heat sinks having large uneven areas and tolerances are ideally thermally bonded to each other. As a result of the excellent ability of the silicone material to adapt the shape thereof, the contact surfaces are enlarged and thermal bonding is significantly improved. The pressure to be applied in the process is low, and the very high elasticity additionally provides mechanical damping. Due to the thermal properties thereof, such soft silicone foils have so far been employed as ideal thermal solutions for use in electronic components on SMD printed circuit boards. Such soft silicone foils can significantly reduce the thermal overall contact resistance between two materials. Such soft silicone materials are available, for example, from Kunze Folien GmbH, Raiffeisenallee 12a, D-82041 Oberhaching (www.heat-mangement.com) and are sold there as highly thermally conductive soft silicone foils KU-TDFD. They are available in different thicknesses: 0.5 mm, 1 mm, 2 mm and 3 mm. The thermal conductivity of this foil material is 2.5 W/mk and the foils can be used in a temperature range of −60° C. to +180° C. Therefore, use between the wear plates 32, 33 and the cooling body K of the grate plates of a garbage incineration grate is possible, since the water-cooled grate plates always remain at a temperature of less than 70° C.

For the use of the hard wear plates 32, 33 it is important that the thermal load level thereof is not exceeded. The high-temperature resistant steels used for the production of the wear plates retain the hardness thereof up to approximately 400° C. By way of cooling provided by the liquid-cooled cooling body, the operating temperature of the wear plates typically remains around 50° C. However, for this purpose sufficient heat transfer from the wear plates 32, 33 to the cooling body K must be ensured. This is enabled precisely by clamping in a soft silicone foil, as described above. The soft silicone foil 31 is placed with precise fit and congruency on the cooling body and the wear plates 32, 33 are placed thereon. They are provided with slots 45, which then come to rest in the cooling body K over the recesses 28-30 such that the primary air can flow from beneath through these lots 45 upward through the carrier carcass and these recesses 29-30. The wear plates 32, 33 are those which rest flush on the cooling body, while clamping the interposed thermally conductive foil, and are mounted by way of screw connections to the bottom side of the carcass, and also those which rest at the front of the tapered front of the cooling body and likewise are mounted to the grate plate carcass by way of screw connections, while clamping the soft silicone foil beneath. In this way, the entire top and front sides of the grate plate facing the material to be incinerated are composed of wear plates 32, 33, which are preferably made of Hardox steel.

The wear plates 32, 33 are mounted to the carrier design, which is to say the grate plate carcass. For mounting, screw connections are suited, for example. The screws are guided through the recesses 28-30 in the cooling body K. The wear plates 32, 33 are then mounted to the cooling body, while clamping the soft silicone foil 31, which has the appropriate cutouts, in that a lock nut is tightened on the bottom side of the grate plate carcass. In this way, optimal heat transfer is ensured. Experiments have shown that through the use of a soft silicone foil the heat transfer is improved up to five times over the absence of such a soft silicone foil. As an alternative to screw connections, the wear plates 32, 33 can also be fastened by rivets, or, for example, pins having countersunk heads are used, which have a cross slot in the region of the end thereof. The only thing required then is to drive a wedge laterally into this slot using a hammer. The connection can be released easily by striking a hammer against the opposite side of the wedge, which is even faster to carry out than loosening a large lock nut.

Instead of silicone foils or soft silicone foils, it is also possible to use thermally conductive foils made of a soft metal or soft metal alloys. Copper or aluminum are examples of such soft metals and additionally conduct heat very well. Such a thermally conductive foil is suited similarly for clamping between the wear plates 32, 33 and the cooling body located beneath and, due to the softness thereof, nestles against the surface structures of the wear plates and cooling body. Everything that has been described above applies analogously to equipping the side planks of a water-cooled grate. These side planks have previously also be produced from water-cooled hollow bodies.

FIG. 6 shows an alternative carrier and drive design without transverse ribs on the inside. It likewise comprises lateral walls 1, 2, which are welded together to form a carcass using a tapered, inclined front wall 48, a vertical center wall 45, and a likewise vertical rear wall 7. The front wall 48 is provided with holes 49, which are used to fasten the cooling body and the wear plates. On the one side, a recess 14 is provided from behind for the drive unit 15. FIG. 7 shows the cooling body K associated with this carcass, wherein as a special feature said cooling body has apertures 46 in the front side 47 through which screws can be placed such that the front wear plates can be fastened to this front surface 47 of the cooling body K. FIG. 8 shows the carrier and drive design according to FIG. 6 having the cooling body according to FIG. 7 inserted therein. The cooling body K can be inserted into the carcass with precise fit. Thereafter, the thermally conductive foil is placed on the top side of the cooling body. The recesses 28, 29 formed by the cooling body remain uncovered. FIG. 9 shows this carrier and drive design having the cooling body inserted therein and the wear plates 32, 33 mounted thereon, while clamping the thermally conductive foil, said plates being mounted by way of screws 34, which are guided downward through the carcass, to the bottom side of the carcass. In FIG. 10, this carrier and drive design is shown in a bottom view, having a cooling body inserted therein and wear plates mounted thereon by clamping the thermally conductive foil. Here, the drive unit 15 is apparent, in which a hydraulic piston-cylinder unit is accommodated, of which here the terminal fixed lug 50 is apparent, and also the opposing lug 17 at the front end of the extendable piston. In addition, the feed tube 43 and return tube 44 and also the screws 34 are apparent, by which the wear plates are fastened to the front.

FIG. 11 shows a sectional view transversely through a liquid-cooled grate having two grate webs R (=right) and L (=left) composed of such grate plates P having a separate cooling body inside. The two grate webs R and L are separated from a central plank 37, which forms a stoking plank both for the grate web R and for the grate web L. At the outer edges of the grate, lateral planks 35, 36 are provided. The grate plates P of every second grate step are designed to be movable and slide back and forth perpendicular to the drawing sheet plate along the central plank 37 and the lateral planks 35, 36. As a result, these lateral planks 35, 36 and also the central plank 37 are subject to wear. Through the use of wear plates on the surface, wherein these wear plates are likewise mounted to the planks 35-37 while clamping in a soft thermally conductive foil, it is possible to offer an elegant solution to the wear problem, without considerably worsening the desired heat dissipation. In order to upgrade a grate equipped in this way with wear plates, they must only be replaced, which is quicker and more cost-effective than replacing all the grate plates and planks. As a result, the liquid-cooled grate is equipped with exchangeable wear plates wherever it comes in contact with material to be incinerated, and also wherever it is subject to wear due to sliding friction. At the same time, however, the cooling action due to liquid cooling is almost unimpaired such that all the advantages still apply.

FIG. 12 shows the central guide plank 37 from FIG. 11 in an enlarged illustration. The wear plates 39 are composed of two parts in this case, and the two parts are joined at the top in the center at point 38. They are secured from both sides by countersunk head screws 40 to the plank 37, wherein they clamp between themselves an inserted thermally conductive foil 31. In the lower region, the grate plates P, which are cooled by the cooling body K and at the top sides thereof are likewise equipped with wear plates 32, rest against the wear plates 39 on the central plank 37.

FIG. 13 shows a lateral guide plank 35 from FIG. 11 in an enlarged illustration. The wear plate 41 in this example is pulled around the plank 35 to some extent. Beneath it, it clamps in a thermally conductive foil 31, and in this example it is screwed to the plank 35 by way of two countersunk head screws 42. In the lower region of the wear plate 41, the grate plates P which are cooled by the cooling body K and at the top thereof are likewise equipped with wear plates 32 rest against the wear plate 41.

The advantages of this grate design comprising a carrier and drive design, a separate cooling body K that is inserted therein and provided with recesses 28-30, and wear plates 32, 33 mounted thereon, with the inclusion of a soft thermally conductive foil 31, are as follows: For maintenance purposes, the individual grate plates P or grate steps no longer have to be removed and replaced, but instead only the wear plates 32, 33; 39, 41 on the grate plates P are replaced, as well as those on the laterally delimiting planks 35, 37, which therefore always remain in place. With the operating temperature thereof in the range of 50° C. to 70° C. and without mechanical wear, the grate plates P and planks made of iron last many years, or even decades. If only one wear plate 32, 33 must be replaced on a grate plate, it costs a fraction of an entire conventional hollow grate plate. In addition, exchanging a wear plate 32, 33; 39, 41 is carried out much more quickly than replacing an entire grate plate, and the associated work is foolproof. If an entire grate plate has to be replaced, the cooling circuit must be interrupted and the coolant must be drained from the plates. The individual grate plates are then lifted out of the grate with comparatively high effort, using a lifting apparatus. The replacement plates must be newly produced in a relatively complex production method. However, if only wear plates 32, 33; 39, 41 have to be replaced, the liquid-cooled grate does not even have to be drained. Only the nuts on the grate plate bottom side have to be loosened, and thereafter the wear plates 32, 33 can be lifted off the grate and exchanged. New countersunk head screws are used, and the new wear plates are again mounted to the grate plates. The same applies to the lateral liquid-cooled planks 35, 37 of the grate. Replacing the wear plates 32, 33; 39, 41 is therefore carried out several times faster than the replacement of entire grate steps, and the production of new liquid-cooled grate plates, which has been required until now, is practically completely eliminated. In addition, thanks to the inserted thermally conductive foil, the heat distribution is significantly improved. Heat is therefore dissipated everywhere uniformly from the grate surface, which is to say the wear plates, and they are largely equally hot over the entire surface thereof. Compared to conventional grate plates in the form of liquid-cooled hollow body designs, the number and arrangement of the air slots can also remain identical with these grate plates having an inserted cooling body and wear plates mounted thereon. They must simply be placed over the recesses in the cooling body. The positioning of the feed and return ports for the coolant can also remain the same. In addition, the cooling cross-sections, the weight, and the shape of the grate plates and also the fastening points for the drive can remain the same. As a result, the grate plates are suited without difficulty for retrofitting existing grate webs. The advantages of the design described here are therefore very obvious.

Experiments conducted so far have produced the following: The upper side of existing grate plates is used up after 35,000 to 45,000 operating hours down to a wall thickness of approximately 4 mm. The entire grate plate is therefore scrap and must be replaced. In contrast, in the present grate plate only the wear plates have to be replaced after this operating time. The carrier and drive design can remain the grate. The costs for replacing the wear plates are a fraction of the existing costs for the full replacement of the grate plates. As a result, these grate plates hold out the promise of a service life that is multiple times longer, while having the same weight. The surface temperature is increased by only 15° C. over the conventional design without wear plates. The operating reliability is improved with these new grate plates, since the cooling bodies on the inside are not damaged even by extreme thermal influences. There are no potential leaks because no welded-in through-pipes are present any longer for the supply of primary air. These new grate plates can be produced with dimensional compatibility using conventional grate plates and may therefore replace the latter even individually, as needed.

The invention claimed is:

1. A liquid-cooled grate step element comprising:

(a) a carcass having a drive unit (15) connected therein;

(b) a cooling body (K) in the form of a separate module inserted in the carcass, the cooling body being a leak-proof hollow body and having at least one continuous recess (28-30) extending approximately over an entire longitudinal extension of the cooling body, wherein through the cooling body a liquid can flow; and (c) exchangeable wear plates (32,33) fastened on top of the cooling body (K) with heat contact and fastened to the carcass, the exchangeable wear plates having multiple primary air slots (45) rest over the recesses (28-30) in the cooling body.

2. The liquid-cooled grate step element according to claim 1, wherein the cooling body (K) has a welded design composed of tube sections (20-26) and profiled sections (27), and the welded design forms said at least one continuous recess (28-30) extending over the entire longitudinal extension of the cooling body, with an exception of portions of the tube sections (23-26) bridging the recess (28-30).

3. The liquid-cooled grate step element according to claim 1, wherein the carcass comprises flat steel parts welded together.

4. The liquid-cooled grate step element according to claim 1, wherein the drive unit (15) encloses a hydraulic cylinder-piston unit (16) accommodated on an inside of a tube (18) that is supported displaceably in the carcass in a tunnel-like aperture (14), and while an piston end is rigidly connected to the carcass.

5. The liquid-cooled grate step element according to claim 1, wherein the exchangeable wear plates (32,33) are made of steel, and are fastened on top of the cooling body (K) and fastened to the carcass by screw or rivet connections.

6. The liquid-cooled grate step element according to claim 1, wherein the liquid-cooled grate step element further comprises a thermally conductive foil (31) between the cooling body (K) and the exchangeable wear plates (32,33) resting congruently on the cooling body (K).

7. The liquid-cooled grate step element according to claim 6, wherein the thermally conductive foil (31) comprises silicone.

8. The liquid-cooled grate step element according to claim 6, wherein the thermally conductive foil (31) is a soft silicone foil.

9. The liquid-cooled grate step element according to claim 6, wherein the thermally conductive foil (31) is a soft metal foil comprising one or more soft metals or alloys thereof.

10. The liquid-cooled grate step element according to claim 6, wherein the thermally conductive foil (31) is clamped between the cooling body (K) and the wear plates (32,33).

11. The liquid-cooled grate step element according to claim 1, wherein the liquid-cooled grate step element further comprises a thermally conductive paste between the cooling body (K) and the wear plates (32,33).

12. A liquid-cooled stepped grate comprising one or more grate step elements of claim 1 per grate step disposed next to each other, wherein the grate step elements overlap from one step to the next, and every second step is movable.

13. The liquid-cooled stepped grate according to claim 12, wherein when a plurality of the grate step elements per grate step are present, the carcass of adjoining grate step elements disposed next to each other are screwed together.

14. The liquid-cooled stepped grate according to claim 12, wherein the liquid-cooled stepped grate further comprises lateral liquid-cooled planks (35,37).

15. The liquid-cooled stepped grate according to claim 14, wherein surfaces of the lateral liquid-cooled planks (35,37) of the liquid-cooled stepped grate are equipped with wear plates (39,41).

16. A liquid-cooled grate step element comprising:

(a) a carcass having a drive unit (15) connected therein;

(b) a cooling body (K) in the form of a separate module inserted in the carcass, the cooling body being a leak-proof hollow body and having at least one continuous recess (28-30) extending approximately over an entire longitudinal extension of the cooling body, wherein through the cooling body a liquid can flow;

(c) exchangeable wear plates (32,33) fastened on top of the cooling body (K) and fastened to the carcass, the exchangeable wear plates having multiple primary air slots (45) rest over the recesses (28-30) in the cooling body; and (d) a thermally conductive foil (31) clamped between the cooling body (K) and the exchangeable wear plates (32, 33), resting congruently on the cooling body (K) and providing heat contact therebetween.

17. The liquid-cooled grate step element according to claim 16, wherein the thermally conductive foil (31) is a soft silicone foil.

18. The liquid-cooled grate step element according to claim 16, wherein the thermally conductive foil (31) is a soft metal foil comprising one or more soft metals or alloys thereof.

19. A liquid-cooled stepped grate comprising one or more grate step elements of claim 16 per grate step disposed next to each other, wherein the grate step elements overlap from one step to the next, and every second step is movable.

20. The liquid-cooled stepped grate according to claim 19, wherein the liquid-cooled stepped grate further comprises lateral liquid-cooled planks (35,37).

* * * * *